United States Patent [19]

Coulson

[11] Patent Number: 4,761,920

[45] Date of Patent: Aug. 9, 1988

[54] LOFT HATCH FRAMES

[75] Inventor: Clifford B. Coulson, Leicestershire, United Kingdom

[73] Assignee: Profilex Limited, Leicestershire, United Kingdom

[21] Appl. No.: 1,239

[22] Filed: Jan. 7, 1987

[30] Foreign Application Priority Data

Jan. 24, 1986 [GB] United Kingdom ..... 8601740

[51] Int. Cl.[4] ..... E06B 1/56

[52] U.S. Cl. ..... 52/19; 52/210; 52/211; 52/657

[58] Field of Search ..... 52/657, 39, 19, 20, 52/200, 28, 210, 211, 204, 716; 98/40.05, 40.07, 29

[56] References Cited

U.S. PATENT DOCUMENTS

| | | | |
|---|---|---|---|
| 435,943 | 9/1890 | Nelson | 52/657 |
| 2,848,761 | 8/1958 | Hahn | 52/211 |
| 3,021,929 | 2/1962 | Carlin | 52/204 |
| 4,105,352 | 8/1978 | Holdiman | 52/657 |
| 4,114,186 | 9/1978 | Dominguez | 52/28 |
| 4,335,552 | 6/1982 | Blanchett | 52/716 |

FOREIGN PATENT DOCUMENTS

| | | | |
|---|---|---|---|
| 2461884 | 3/1981 | France | 52/657 |

*Primary Examiner*—John E. Murtagh
*Attorney, Agent, or Firm*—Carothers & Carothers

[57] ABSTRACT

A kit of parts for constructing a loft hatch frame comprises four extruded 'T'-section mouldings 12 and four corner plates 14. Each moulding 12 comprises an elongate face plate 12*a* and an upstanding longitudinal web 12*b* upstanding generally centrally from the face plate. In use the mouldings 12 are cut slightly shorter than the sides of the loft access opening, and nailed to the ceiling purlins through the upstanding webs 12*b.* The face plates 12*a* closely abut the ceiling and together provide an internal shoulder on which an access panel rests. Each of the four corner plates 14 has a pair of recesses 16 formed therein, shaped to receive the ends of the face plates 12*a* of a pair of the extruded mouldings 12. Thus the corner plates 14 mask the junction between adjacent mouldings 12, and provide a neat finish even though the mouldings have not been cut to exact length.

12 Claims, 3 Drawing Sheets

LOFT HATCH FRAMES

DESCRIPTION

This invention relates to the construction of access openings for lofts, typically the lofts of domestic houses, and provides a loft hatch frame construction kit that permits a loft access hatch to be fitted quickly, neatly and inexpensively.

The traditional loft hatch frame is created by nailing timber as a subframe to the inside of the roof purlins that define the access opening. A top edge of that timber subframe forms a shoulder around the inside of the access opening, on which the hatch itself rests. The hatch is typically simply a piece of board, such as plywood, optionally weighted on top to prevent it from rattling. The bottom edge of the timber subframe butts up to the plasterboard or tiles of the ceiling, and the resulting ragged joint is obscured by nailing an underframe of architrave timber to the subframe, parallel to the plane of the ceiling. There are two principal disadvantages to this traditional method of construction. One is that it is time-consuming and requires the skill of a joiner to construct the frame on site to the exact size of the opening. The underframe requires mitre joints, which if not executed properly detract from the appearance. The other disadvantage is that the loft access panel is displaced above the plane of the ceiling by the width of the timber used for the subframe. This can be aesthetically displeasing, especially for small access openings.

The present invention provides a kit of parts for assembly into a loft hatch frame that avoids the above disadvantages. The kit of parts of the invention comprises eight separate elements, namely four extruded mouldings each comprising an elongate face plate and a generally central longitudinal web upstanding therefrom, and four corner plates each having formed therein a pair of mutually perpendicular channels each of which is dimensioned to receive an end portion of a face plate of one of the extruded mouldings and thereby to overlie and mask the junction between adjacent extruded mouldings.

Advantageously the channels in the corner plates are of a length sufficient to accommodate at least two or three cm of the face plates of the extruded mouldings, so that inaccuracies in the cutting or measurement of the extruded mouldings can be masked by having the extruded mouldings fill less than the complete length of the channels.

In use, the extruded mouldings are cut to the approximate size of the desired loft access opening, but all slightly shorter than the corresponding side of the opening. They are then secured in position by nailing, screwing, rivetting or stapling the central upstanding longitudinal webs of the respective mouldings to the sides of the ceiling purlins around the access opening. The upstanding web may be preformed with apertures for the screws or nails for this operation. The face plate of each moulding should at this stage closely abut the plasterboard or other cladding material of the ceiling around the access opening. The four corner plates are then secured in position to mask the gaps deliberately left at the junction between adjacent pairs of extruded mouldings. The securing of the corner plates may be to the ceiling cladding, to the ceiling purlins or to the mouldings themselves according to design preference.

To permit fastening of the corner plates to the ceiling cladding all that is required is one or two screws or nails vertically upwardly through each corner plate into the ceiling cladding and optionally through the ceiling cladding on into the underside of the ceiling purlins. However the screw or nail heads would in such a design be visible from below.

To permit fastening of the corner plates to the ceiling purlins without any nail heads being visible from below, each corner plate is advantageously provided with a pair of upstanding webs which can be screwed, rivetted, nailed or stapled to the sides of the ceiling purlins in a similar manner to the fastening of the extruded mouldings themselves.

To permit fastening of the corner plates to the extruded mouldings, each channel in each corner plate is advantageously provided with resiliently deformable detent means permitting the corner plate to be clipped around and supported by the face plates of the extruded mouldings. Preferably the detent means comprises a portion of the corner plate formed to overlie the top of the end portion of each extruded moulding face plate lying to the inside of the central upstanding web.

The extruded mouldings and the corner plates may very conveniently be made from thermoplastics materials.

DRAWINGS

Figure 1:
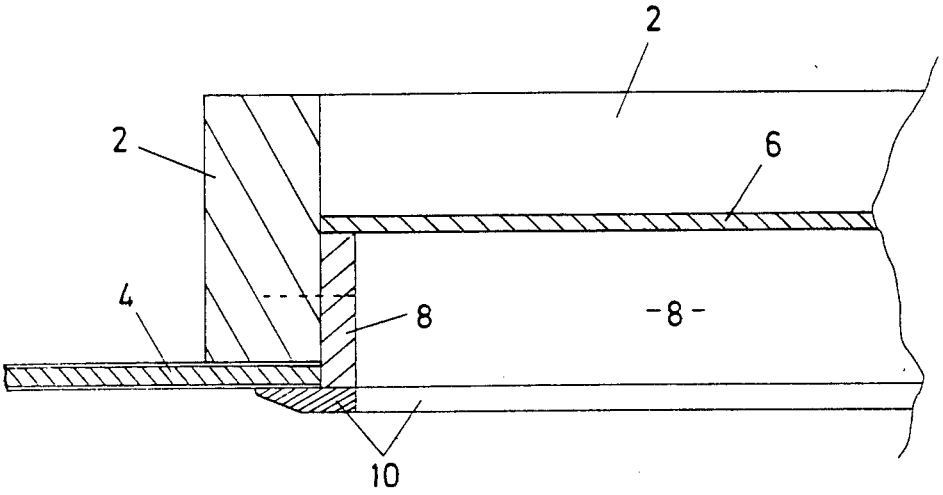
FIG. 1 (PRIOR ART)
FIG. 1 is a vertical section through a corner of a loft access frame constructed according to traditional methods.

Referring first to FIG. 1, the loft access opening is defined by a rectangular opening between ceiling purlins 2. Ceiling cladding such as plasterboard 4 covers the ceiling all around the access opening. A frame to support a board 6 is formed by nailing timber 8 to the sides of the purlins 2. The board 6 simply rests on a shoulder formed by the top edges of the four pieces of timber 8. The junction between the plasterboard 4 and the timber 8 is masked by architrave timber 10 nailed upwardly into the timber 8. The corners of the architrave timber 10 are mitred for neatness.

Disadvantages of the above method of construction are that the plane of the board 6 is offset above the plane of the ceiling by an amount equal to the width of the timber 8; that the whole must be constructed on site generally by a joiner working from below at an uncomfortable working location; and that the mitre joint at the corners has to be skillfully constructed to look at its most elegant.

Figure 2:
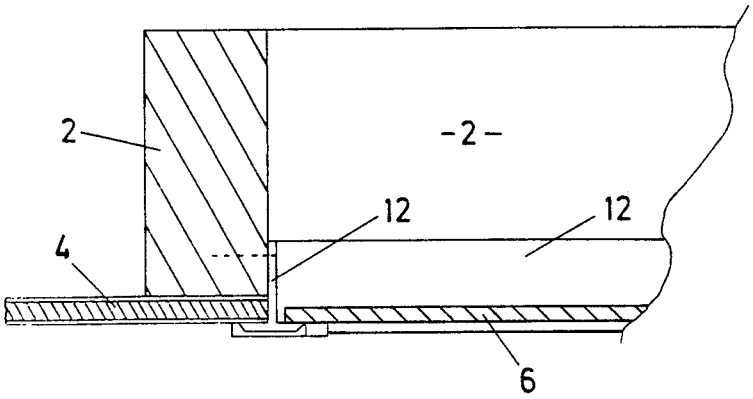
FIG. 2 is a vertical section through a corresponding corner of a loft access frame constructed from a kit according to this invention.
Figure 3:
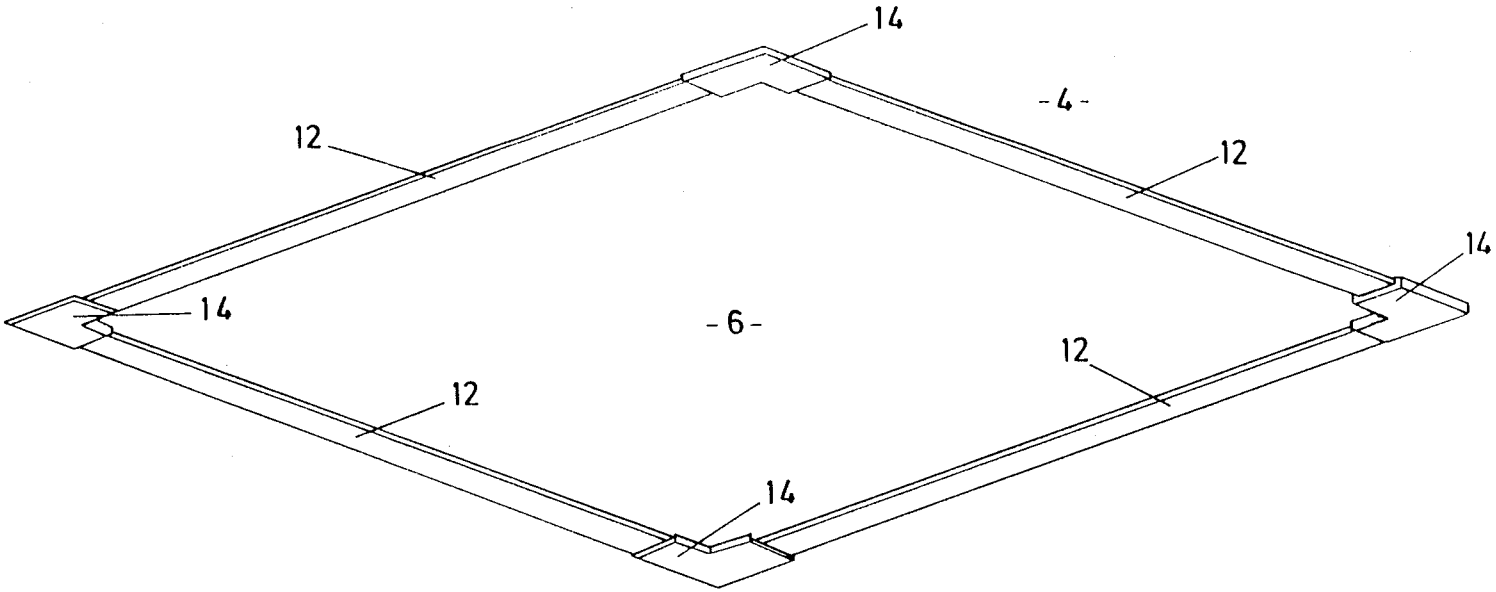
FIG. 3 is a perspective view from below of a loft access hatch supported by a frame constructed from a kit according to this invention.
Figure 4:
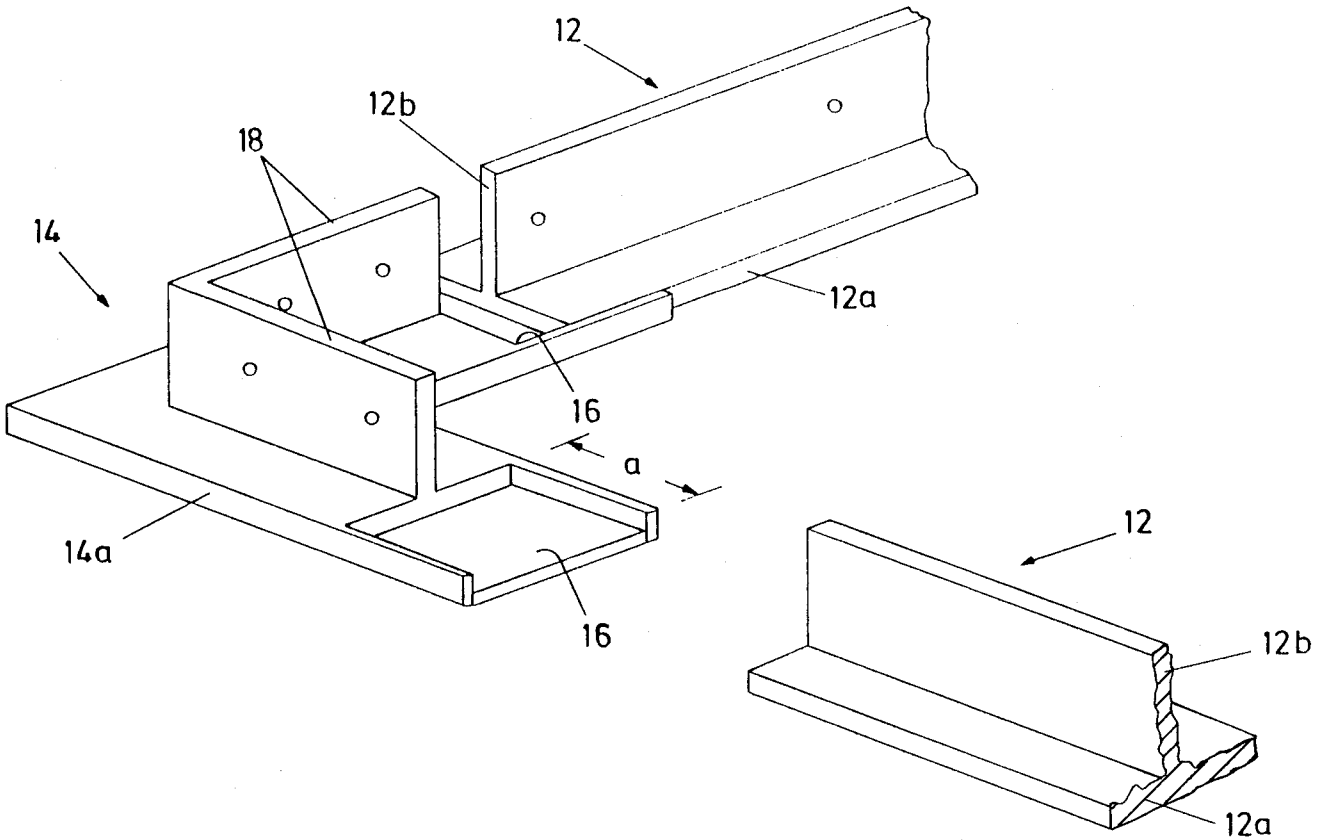
FIG. 4 is an exploded view of one corner of the frame of FIGS. 2 and 3.

FIGS. 2 to 4 illustrate one embodiment of a loft access frame constructed from a kit according to the invention. Four lengths of extruded T-section moulding 12 are first cut to the approximate lengths of the respective sides of the access opening. Each length of moulding will in fact be cut anything from 6 to 10 cm shorter than the corresponding side of the opening. The four mouldings 12 are then secured, for example by pinning, to the purlins 2 around the access opening. Each moulding 12 comprises an elongate face plate 12*a* forming the cross-piece of the 'T' section and an upstanding web portion 12b forming the upright of the 'T' section. The mouldings 12 are secured in place by pinning through the web portions 12b into the sides of the purlins 2, with the outer half top surface of each face plate 12a being fast against the underside of the plasterboard 4 around the opening. The inner half top surface of each face plate 12a forms the shoulder on which the access panel 6 rests, and it will be seen that the access panel 6, from below, is thus automatically brought flush with the ceiling even though the panel 6 may not necessarily be of material the same thickness as the plasterboard 4.

After securing the mouldings 12 in position four corner plates 14 are fitted, to provide the attactive finished appearance of FIG. 3. As can best be seen from FIG. 4, each corner plate 14 comprises an 'L'-shaped face plate 14a in which are formed a pair of channels 16 shaped to receive the ends of the face plates 12a of the respective extruded mouldings 12. Each channel has a length 'a' of about 2.5 cm, so that it can accommodate and mask a substantial variation in the cut length of the mouldings 12.

The corner plate of FIG. 4 is formed with conjoined upstanding webs 18 which in use are pinned to the sides of the ceiling purlins 2 in the same way as the web portions 12b of the extruded mouldings 12. It will be appreciated that the entire construction is designed to facilitate assembly by unskilled labour. All the nailing or pinning is to vertical surfaces, so that the difficulty of nailing from below into a horizontal ceiling is avoided. The webs 14b thus function in the manner of a detent retention mechanism.

I claim:

1. A ceiling loft hatch assembly comprising:

A ceiling structure including ceiling support members clad on their underside with cladding means;

means defining an access opening through said ceiling structure, including a rectangular arrangement of four purlins coplanar with the ceiling structure, inwardly facing vertical edge faces of the four purlins cooperating with one another to define the access opening;

four extruded mouldings each comprising an elongate face plate having a planar upper surface and a generally central longitudinal web upstanding therefrom;

means securing the web of each moulding to a respective one of the purlin inwardly facing vertical edges with one half of each elongate face plate underlying the ceiling cladding means around the access opening and with the respective said upper surfaces thereof in engagement with the confronting surface of said ceiling cladding means such that the other half of each elongate face plate projects into the access opening with said upper surface thereof in the plane of said confronting surface to provide a support surface for supporting a loft closure panel with the lower surface thereof coplanar with said confronting surface;

four corner plates each having formed therein a pair of mutually perpendicular upwardly open channel recesses each of which receives an end portion of one of the said extruded mouldings to overlie and mask the adjacent ends of said extruded mouldings; and a loft closure panel removably filling the access opening by resting on said support surface formed by said other halves of the respective elongate face plates.

2. An assembly according to claim 1, wherein said extruded mouldings are made from an extruded thermoplastics material.

3. An assembly according to claim 2, wherein said corner plates are made from a theremoplastics material.

4. An assembly according to claim 1, wherein said securing means comprise screws or nails, and said upstanding web of each said extruded moulding is preformed with apertures therefor.

5. An assembly according to claim 1 wherein each said corner plate is provided with a pair of upstanding webs for securing the corner plate to an adjacent pair of the said purlins.

6. An assembly according to claim 1 wherein each said corner plate is provided with resilient deformable detent means overlying a portion of each channel, enabling the corner plate to be clipped over the face plates of a pair of mutually perpendicular mouldings and retained in position by the detent means.

7. In a ceiling loft hatch wherein a ceiling structure includes ceiling puirlins clad on their underside with cladding means and forming an access opening through said ceiling structure by means of a generally polygonal arrangement of selected ones of said purlins such that inwardly facing vertical faces of said selected purlins cooperate with one another to define said access opening, a loft hatch opening assembly comprising:

a plurality of extruded mouldings each comprising an elongated face plate portion having a generally planar upper surface and an elongated web portion extending longitudinally of said face plate portion intermediate the longitudinal edges thereof and upstanding therefrom;

each of said extruded mouldings corresponding to one of said inwardly facing vertical faces;

said web portion of each said moulding including means cooperable with a securing means for securing said moulding with respect to the respective one of said inwardly facing vertical faces with said upper surface of a portion of the respective said elongated face plate to one lateral side of said web underlying and engaging a lower surface of the ceiling cladding means around the access opening and said upper surface of another lateral portion of the respective said elongated face plate projecting into the access opening in the plane of the lower surface of the ceiling cladding means;

a plurality of corner plate means corresponding to the respective corners of said polygonal arrangement; and each said corner plate means including face plate means corresponding to respective ones of said face plate portions and each said face plate means having formed therein a pair of channels which receive the respective adjacent end portions of a pair of said extruded mouldings to overlie and mask said respective adjacent end portions.

8. The assembly as claimed in claim 7 additionally including a loft closure panel of a geometry to removably fill said access opening by resting on the said another lateral portion of each of said elongated face plates.

9. The assembly as claimed in claim 8 wherein said extruded mouldings are of extruded thermoplastic material.

10. The assembly as claimed in claim 9 wherein said corner plates are of thermoplastic material.

11. The assembly as claimed in claim 10 wherein said means cooperable with a securing means includes plural through apertures formed in said web portions of each said extruded moulding.

12. The assembly as claimed in claim 11 wherein each said corner plate additionally includes upstanding web means corresponding to the respective said web portions for securing said corner plate to an adjacent pair of said purlins.

* * * * *